US010378262B2

(12) United States Patent
Yulkowski

(10) Patent No.: US 10,378,262 B2
(45) Date of Patent: Aug. 13, 2019

(54) DOOR OPERATOR AND CLUTCH

(71) Applicant: Leon Yulkowski, Waterford, MI (US)

(72) Inventor: Leon Yulkowski, Bloomfield Hills, MI (US)

(73) Assignee: Leon Yulkowski, Bloomfield Hills, MI (US)

( * ) Notice: Subject to any disclaimer, the term of this patent is extended or adjusted under 35 U.S.C. 154(b) by 654 days.

(21) Appl. No.: 14/920,432

(22) Filed: Oct. 22, 2015

(65) Prior Publication Data

US 2016/0115725 A1 Apr. 28, 2016

Related U.S. Application Data

(60) Provisional application No. 62/067,857, filed on Oct. 23, 2014.

(51) Int. Cl.
*E05F 15/603* (2015.01)
*E05F 15/70* (2015.01)

(52) U.S. Cl.
CPC ..... *E05F 15/603* (2015.01); *E05F 15/70* (2015.01)

(58) Field of Classification Search
CPC ..... E05F 15/603; E05F 15/611; E05F 15/63; E05F 2015/631
See application file for complete search history.

(56) References Cited

U.S. PATENT DOCUMENTS 1,684,704 A * 9/1928 Hubbell ..... E05F 15/63 49/139
3,039,764 A 6/1962 Heinsman et al.
4,333,268 A 6/1982 Dumbeck
4,562,664 A 1/1986 Kambic
4,698,937 A 10/1987 Kombrekke et al.
4,727,679 A * 3/1988 Kornbrekke ..... E05F 15/63 49/138
4,952,080 A 8/1990 Boiucaner et al.
4,980,618 A 12/1990 Milnes et al.
5,018,304 A * 5/1991 Longoria ..... E05F 15/63 49/26
5,040,331 A 8/1991 Merendino et al.
5,072,973 A 12/1991 Gudgel et al.
5,250,765 A 10/1993 Mizuno et al.
5,289,162 A 2/1994 McDaniel
5,375,374 A 12/1994 Rohraff, Sr.
5,392,562 A 2/1995 Carambula
5,583,405 A 12/1996 Sai et al.
5,770,934 A 6/1998 Theile
(Continued)

FOREIGN PATENT DOCUMENTS

DE 10 2007 038 421 9/2008
WO 2008/078029 7/2008

OTHER PUBLICATIONS

No. of Pages 5, Mar. 14, 2018, U.S. Appl. No. 15/389,086.
(Continued)

*Primary Examiner* — Gregory J Strimbu
(74) *Attorney, Agent, or Firm* — Evan Law Group LLC

(57) ABSTRACT

A door operator, for opening and closing a door with a motor, comprises a worm drive, a clutch coupled to the worm drive, and an output shaft coupled to the clutch. The worm drive comprises a worm and a worm gear. The door operator allows for the use of a low voltage motor to be used to open and close the door.

20 Claims, 11 Drawing Sheets

(56) References Cited

U.S. PATENT DOCUMENTS 5,813,171 A * 9/1998 Piltingsrud ..... E05F 15/63 49/139
5,878,530 A 3/1999 Eccleston et al.
5,913,763 A 6/1999 Beran et al.
6,034,494 A 3/2000 Kitamine et al.
6,049,287 A 4/2000 Yulkowski
6,154,924 A 12/2000 Woo
6,183,023 B1 2/2001 Yulkowski
6,223,469 B1 5/2001 Moll
6,259,352 B1 7/2001 Yulkowski et al.
6,316,892 B1 11/2001 Valencia
6,318,024 B1 11/2001 Krsnak et al.
6,336,294 B1 1/2002 Kowalczyk et al.
6,338,693 B1 1/2002 Scholten et al.
6,481,160 B1 11/2002 Kowalczyk
6,553,238 B1 4/2003 Ginzel et al.
6,553,717 B2 4/2003 St. John et al.
6,588,153 B1 7/2003 Kowalczyk
6,705,047 B2 3/2004 Yulkowski
6,715,586 B1 4/2004 Shubin
6,724,304 B2 4/2004 Risi
6,751,909 B2 6/2004 Ranaudo
6,788,000 B2 9/2004 Appelberg et al.
6,854,565 B2 2/2005 Peralaet et al.
6,891,479 B1 5/2005 Eccleston
6,967,451 B2 11/2005 Miyauchi
6,970,085 B2 11/2005 Okabe et al.
6,988,594 B2 1/2006 Deplazes et al.
7,070,226 B2 7/2006 Cleland et al.
7,143,548 B2 12/2006 Kleinmann et al.
7,145,436 B2 12/2006 Ichikawa et al.
7,224,275 B2 5/2007 Fitzgibbon
7,263,802 B2 9/2007 Fitzgibbon et al.
7,316,096 B2 1/2008 Houser et al.
7,382,063 B2 6/2008 Mullet et al.
7,418,800 B1 9/2008 Sellman
7,493,726 B2 2/2009 Fitzgibbon et al.
7,999,690 B1 8/2011 Shilts
8,261,491 B2 9/2012 Yulkowski et al.
8,405,337 B2 * 3/2013 Gebhart ..... H02P 6/085 318/400.01
8,653,982 B2 2/2014 Yulkowski et al.
8,844,200 B2 9/2014 Yulkowski et al.
8,907,791 B2 12/2014 Yulkowski et al.
9,536,357 B2 1/2017 Yulkowski et al.
2002/0026750 A1 3/2002 St. John et al.
2002/0092237 A1 7/2002 Hebda
2002/0104266 A1 8/2002 Ranaudo
2002/0178655 A1 12/2002 Pedemonte
2003/0005639 A1 1/2003 Kowaiczyk
2003/0213177 A1 11/2003 Fitzgibbon et al.
2003/0217894 A1 11/2003 Perala et al.
2004/0046418 A1 * 3/2004 Chikata ..... E05F 15/63 296/146.4
2004/0187387 A1 9/2004 Hedrich
2004/0251868 A1 12/2004 Sato et al.
2005/0091928 A1 * 5/2005 Okulov ..... E05F 15/41 49/341
2005/0198063 A1 9/2005 Thomas et al.
2005/0217097 A1 10/2005 Solfronk
2006/0167656 A1 7/2006 Shimonishi
2006/0197481 A1 9/2006 Hotto et al.
2006/0244271 A1 11/2006 Hass
2006/0267409 A1 11/2006 Mullet et al.
2006/0293821 A1 12/2006 Takahashi
2007/0108927 A1 5/2007 Valencia et al.
2007/0193220 A1 8/2007 Daniels
2008/0061963 A1 3/2008 Schnitz et al.
2008/0168714 A1 * 7/2008 Watanabe ..... E05F 15/63 49/349
2008/0203760 A1 8/2008 Cafeo et al.
2008/0209228 A1 8/2008 Chandler
2008/0246607 A1 10/2008 Smith
2009/0185197 A1 7/2009 Wilson et al.
2009/0186736 A1 * 7/2009 Ta ..... A47K 13/10 475/153
2009/0249699 A1 10/2009 Yulkowski
2010/0114525 A1 5/2010 Ollivier et al.
2010/0242368 A1 9/2010 Yulkowski
2011/0016971 A1 * 1/2011 Yulkowski ..... E05F 15/40 73/493
2013/0118079 A1 5/2013 Yulkowski et al.
2013/0199321 A1 * 8/2013 Oberle ..... F16D 7/021 74/89.14
2014/0182206 A1 7/2014 Yulkowski et al.
2015/0059249 A1 3/2015 Yulkowski
2015/0137963 A1 5/2015 Yulkowski et al.
2016/0273617 A1 * 9/2016 Nickel ..... F16H 1/203
2017/0152696 A1 6/2017 Yulkowski et al.

OTHER PUBLICATIONS

No. of Pages 6, Mar. 28, 2018, U.S. Appl. No. 15/389,086.
U.S. Appl. No. 15/389,086, filed Dec. 22, 2016.
No. of Pages 6, Jun. 26, 2017, U.S. Appl. No. 14/485,452.
No. of Pages 2, Jul. 5, 2017, U.S. Appl. No. 14/485,452.
No. of Pages 35, Jul. 20, 2017, U.S. Appl. No. 14/485,452.
No. of Pages 27, Sep. 19, 2017, U.S. Appl. No. 13/589,471.
No. of Pages 5, May 1, 2012, U.S. Appl. No. 12/719,954.
No. of Pages 4, May 8, 2012, U.S. Appl. No. 12/416,622.
No. of Pages 3, Jan. 30, 2012, U.S. Appl. No. 12/416,622.
No. of Pages 19, Sep. 16, 2011, U.S. Appl. No. 12/416,622.
No. of Pages 5, Jul. 25, 2011, U.S. Appl. No. 12/416,622.
No. of Pages 11, Apr. 20, 2012, U.S. Appl. No. 12/416,622.
No. of Pages 4, Oct. 23, 2012, U.S. Appl. No. 12/719,954.
No. of Pages 23, Jul. 5, 2012, U.S. Appl. No. 12/719,954.
No. of Pages 3, Jun. 5, 2012, U.S. Appl. No. 12/719,954.
No. of Pages 8, Oct. 4, 2011, PCT/US2010/027423.
No. of Pages 4, Jun. 18, 2010, PCT/US2010/027423.
No. of Pages 8, Feb. 2, 2012, PCT/US2010/042286.
No. of Pages 4, Apr. 13, 2011, PCT/US2010/042286.
No. of Pages 20, Jan. 28, 2013, U.S. Appl. No. 12/837,194.
No. of Pages 30, Feb. 14, 2013, U.S. Appl. No. 12/719,954.
No. of Pages 2, May 7, 2013, U.S. Appl. No. 12/719,954.
No. of Pages 6, May 13, 2013, U.S. Appl. No. 13/589,471.
No. of Pages 10, Jul. 11, 2013, U.S. Appl. No. 12/719,954.
No. of Pages 3, Jul. 30, 2013, U.S. Appl. No. 12/719,954.
No. of Pages 16, Aug. 27, 2013, U.S. Appl. No. 12/837,194.
No. of Pages 25, Oct. 3, 2013, U.S. Appl. No. 12/719,954.
No. of Pages 27, Oct. 3, 2013, U.S. Appl. No. 13/589,471.
No. of Pages 15, May 19, 2014, U.S. Appl. No. 14/139,699.
No. of Pages 12, May 29, 2014, U.S. Appl. No. 12/719,954.
No. of Pages 25, Jun. 4, 2014, U.S. Appl. No. 13/589,471.
No. of Pages 3, Jul. 24, 2014, U.S. Appl. No. 14/139,699.
No. of Pages 3, Dec. 23, 2014, U.S. Appl. No. 13/589,471.
No. of Pages 14, Sep. 2, 2014, U.S. Appl. No. 14/139,699.
No. of Pages 3, Oct. 16, 2014, U.S. Appl. No. 14/139,699.
No. of Pages 25, Jun. 11, 2015, U.S. Appl. No. 13/589,471.
No. of Pages 5, Jun. 30, 2015, U.S. Appl. No. 14/485,452.
No. of Pages 23, Feb. 9, 2016, U.S. Appl. No. 14/485,452.
No. of Pages 25, Feb. 11, 2016, U.S. Appl. No. 14/547,434.
No. of Pages 16, Feb. 19, 2016, U.S. Appl. No. 13/589,471.
U.S. Appl. No. 13/589,471, filed Aug. 20, 2012.
U.S. Appl. No. 14/485,452, filed Sep. 12, 2014.
U.S. Appl. No. 14/547,434, filed Nov. 19, 2014.
International Search Report dated Jun. 18, 2010 for PCT application No. PCT/US2010/027423.
No. of Pages 3, Dec. 2, 2016, U.S. Appl. No. 14/547,434.
No. of Pages 33, Dec. 21, 2016, U.S. Appl. No. 14/485,452.
No. of Pages 19, Jan. 24, 2017, U.S. Appl. No. 13/589,471.
No. of Pages 3, Jul. 14, 2016, U.S. Appl. No. 13/589,471.
No. of Pages 7, Jun. 13, 2016, U.S. Appl. No. 13/589,471.
No. of Pages 20, Jun. 16, 2016, U.S. Appl. No. 14/485,452.
No. of Pages 3, Jun. 20, 2016, U.S. Appl. No. 13/589,471.
No. of Pages 6, Jul. 6, 2016, U.S. Appl. No. 13/589,471.
No. of Pages 3, Sep. 8, 2016, U.S. Appl. No. 13/589,471.
No. of Pages 11, Sep. 8, 2016, U.S. Appl. No. 14/547,434.

(56) References Cited

OTHER PUBLICATIONS

No. of Pages 2, Sep. 20, 20116, U.S. Appl. No. 14/547,434.
No. of Pages 23, Nov. 21, 2017, U.S. Appl. No. 15/389,086.
No. of Pages 14, Jan. 15, 2019, U.S. Appl. No. 16/019,385.
U.S. Appl. No. 16/211,023, filed Dec. 5, 2018.
U.S. Appl. No. 16/019,385, filed Jun. 26, 2018.

* cited by examiner

DOOR OPERATOR AND CLUTCH

BACKGROUND

Door operators employ a mechanical device to replace the human effort of pushing or pulling a door. Automated doors make entrances accessible to disabled users as well as increase the convenience for all users.

A common door operator design uses a motor to open a door and a strong spring to close the door. As the door is opened, the spring is compressed. The relaxation of the spring returns the door to its original position. A significant limitation presented by these types of door operators is that they require a powerful motor to compress the spring.

An alternative door operator design eliminates the spring and uses a reversible motor to both open and close the door. Eliminating the spring greatly reduces the amount of power needed from the motor. Although a less powerful motor may be used, the motor must still be able to generate about 30 foot-pounds of force in order to move the door open and closed.

Small, low voltage electric motors offer many potential advantages in door operators. A small motor reduces the physical size of the door operator and allows for greater design flexibility. Low voltage motors are typically less expensive to maintain and operate than more powerful motors. Also, low voltage motors produce less noise than more powerful motors, which makes them well suited in locations such as hospitals, libraries, or houses of worship where quiet operation is preferred. Despite these advantages, low voltage electric motors have failed to gain widespread use in door operators. Low voltage electric motors generally operate at high speeds and produce low torque, making them unsuitable for use in automatic door operators.

SUMMARY

In a first aspect, the present invention is a door operator, for opening and closing a door with a motor, comprising a worm drive, a clutch coupled to the worm drive, and an output shaft coupled to the clutch. The worm drive comprises a worm and a worm gear.

In a second aspect, the present invention is a door assembly, comprising a door, a door operator and a motor coupled to the worm drive. The motor is capable of moving the output shaft to move the door between an open position and a closed position, and between a closed position and an open position. The output shaft is coupled to the door.

In a third aspect, the present invention is a method of operating a door with the door operator, comprising applying current having a first polarity to the motor, to activate the motor in a first direction to open the door; and applying current having a second polarity opposite the first polarity to the motor, to activate the motor in a second direction opposite the first direction to close the door.

In a fourth aspect, the present invention is a door operator, for opening and closing a door with a motor, comprising a worm drive, an output shaft coupled to the worm drive, and means for preventing the door from moving when the door encounters an obstruction. The worm drive comprises a worm and a worm gear.

In a fifth aspect, the present invention is a door operator, for opening and closing a door, comprising a low voltage motor, a means for stepping down the revolutions per minute of the low voltage motor coupled to the low voltage motor, and an output shaft, coupled to the means for stepping down the revolutions per minute of the low voltage motor.

In a sixth aspect, the present invention is a door assembly, comprising a door, a door operator coupled to the door, a motor coupled to a worm drive, at least one battery in communication with the motor, a controller, and an input device. The gear assembly together with the worm drive has a step down gear ratio of at least 500:1. The door operator does not comprise a spring. The door operator comprises a worm drive, a gear assembly including a plastic gear, a clutch coupled to the worm drive by the gear assembly, and an output shaft coupled to the clutch. The motor is capable of moving the output shaft to move the door between an open position and a closed position, and between a closed position and an open position. The worm drive comprises a worm and a worm gear.

In a seventh aspect, the present invention is a door operator, for opening and closing a door with a motor, comprising a worm, a clutch comprising a worm gear coupled to the worm, and an output shaft coupled to the clutch. The clutch disengages from the output shaft under a predetermined resistance.

DEFINITIONS

The term "worm" means a gear in the form of a screw.

The term "worm gear" means a gear that meshes with a worm. A worm gear is also known as a "worm wheel." "Worm gear" is sometimes used to refer to the entire worm drive as opposed to one component of the worm drive. For clarity, these terms will not be interchanged in the specification or claims and "worm gear" will only refer to a gear that meshes with a worm.

The term "worm drive" means a gear arrangement where a worm meshes with a worm gear.

The term "low voltage" means a voltage up to and including 50V.

The term "high voltage" means a voltage greater than 50V.

BRIEF DESCRIPTION OF THE DRAWINGS

The invention can be better understood with reference to the following drawings and description. The components in the figures are not necessarily to scale, emphasis instead is placed upon illustrating the principles of the invention.

DETAILED DESCRIPTION

The present invention makes use of the discovery that combining a worm drive and a low voltage electric motor in a door operator produces a door operator that is strong enough to open and close an automated door without a spring. The door operator includes a worm drive, having a worm and a worm gear; a clutch, coupled to the worm drive; and an output shaft, coupled to the clutch. The worm drive steps down the revolutions per minute of a low voltage electric motor while increasing the torque produced by the motor, enabling the use of motors that are smaller and cheaper than high voltage motors. A worm drive is also more compact than a comparable spur gear, which reduces the total size of the door operator. The door operator may include a secondary power source to allow the door operator to continue to function in the event of a power outage. The present invention therefore provides a door operator that is smaller, cheaper, quieter, and safer than existing door operators.

The present invention also makes use of the discovery of a novel clutch that includes a worm gear. The clutch disengages the motor if the door encounters resistance exceeding a predetermined value during opening or closing. The clutch disengages if it is unable to rotate normally due to resistance and re-engages when the resistance is removed without the need for manual resetting. Including the novel clutch in a door operator prevents injury to users and protects the motor from damage.

Figure 1:
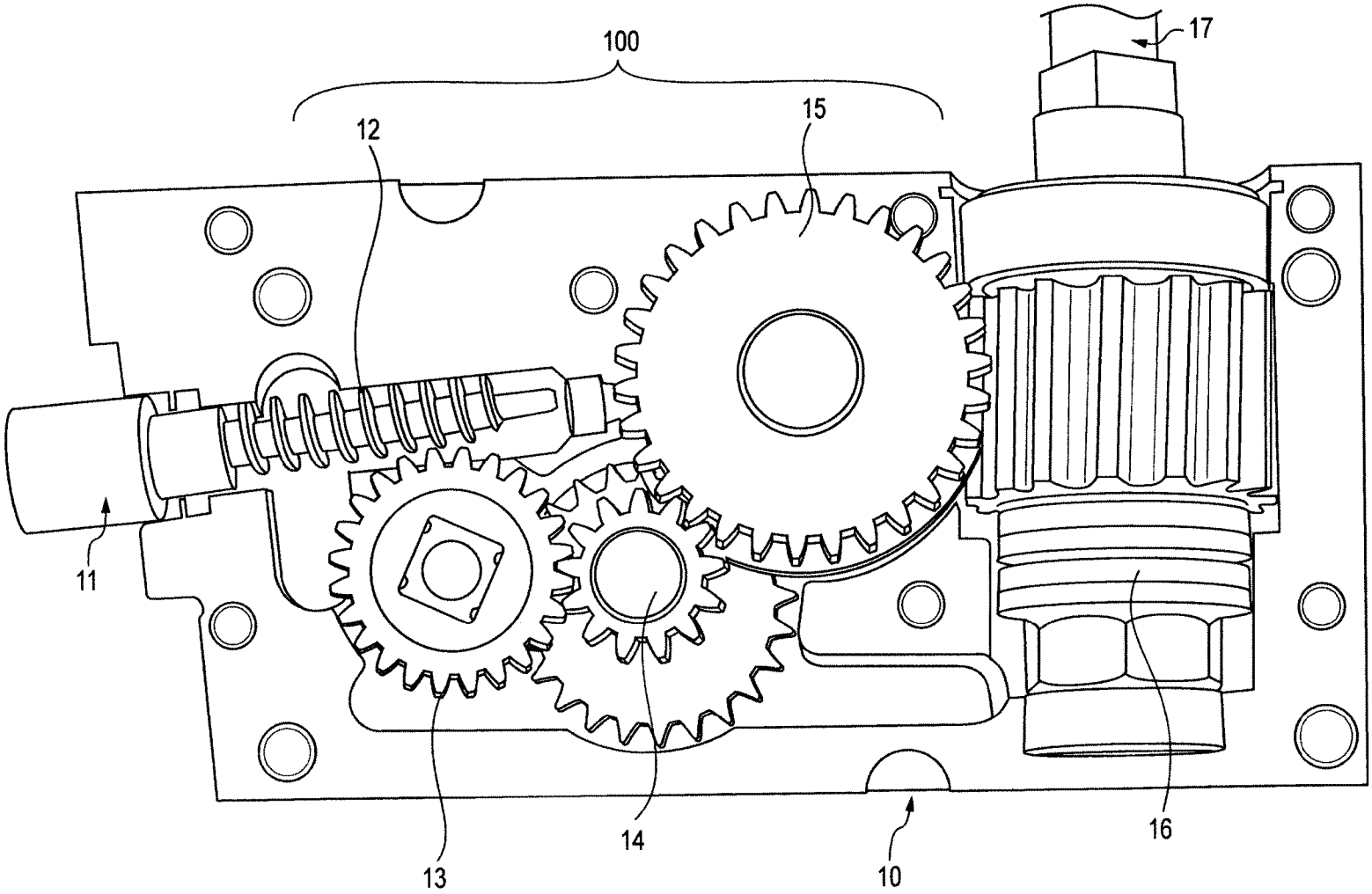
FIG. 1 shows a door operator.

FIG. 1 illustrates a door operator 10. A motor 11 is coupled to a worm 12. The worm 12 is coupled to a clutch 16 by a gear assembly 100. The gear assembly shown in FIG. 1 includes an input pinion 13, a jack shaft 14, and an output pinion 15. The clutch is coupled to an output shaft 17, which is coupled to a door (not shown). Movement of the output shaft moves the door open and closed.

The motor 11 may be any electric motor, but is preferably a low voltage motor. Low voltage motors do not require high current and are less expensive to operate than higher voltage motors, and are therefore preferred. The motor may be powered by an alternating current (AC) source, or preferably a direct current (DC) source. The motor must be capable of operating in both forward and reverse directions so that it is able to open and close the door. In a DC motor, the rotation of the motor is determined by the polarity of the current supplied to the motor. Current of an initial polarity causes the motor to rotate and move the door open. When the polarity is reversed, the motor rotates in the opposite direction and the door is closed. Preferably, the motor is a commercially-available motor. An example of an acceptable motor is a 24 volt motor for operating a car or truck window.

The door operator 10 may optionally have a secondary power source. The secondary power source allows the door operator to continue working in the event of a power outage. Preferably, the secondary power source will be able to perform about 500 openings and closings. One example of a secondary power source is a battery. Any size, type, or combination of batteries may be used as long as the batteries provide sufficient power to operate the door during a power outage. One example of a secondary power source is three 9 volt batteries connected in series to operate a 24 volt motor.

The worm 12 is coupled to the motor 11. Worm drives are ideal choices for use with high speed, low torque motors because they reduce the revolutions per minute (RPM) and increase the torque. Worm drives typically have large gear ratios due to the fact that the worm has a single gear tooth.

A gear assembly 100 couples the worm 12 to the clutch 16. The number of gears and the gear sizes are selected to provide the desired gear ratio to step down the RPM and increase the torque of the motor. The gear ratio of the gear assembly together with the worm is at least 500:1, preferably at least 1000:1, such as 2000:1; other examples include 500:1 to 5000:1, or 1000:1 to 3000:1, including 1800:1 to 2200:1. The gear assembly is chosen so that the door operator has sufficient power to open and close the door in a controlled manner. The gears may be constructed of any durable, rigid material such as metals, plastics, or ceramics. It is preferable to include one or more gears made of plastic because plastic gears produce less noise than metal gears. The gears may be monolithic or composed of multiple components. FIG. 1 illustrates an exemplary gear assembly that includes an input pinion 13, a jack shaft 14, and an output pinion 15. These elements are shown in more detail in FIGS. 2-4.

Figure 2:
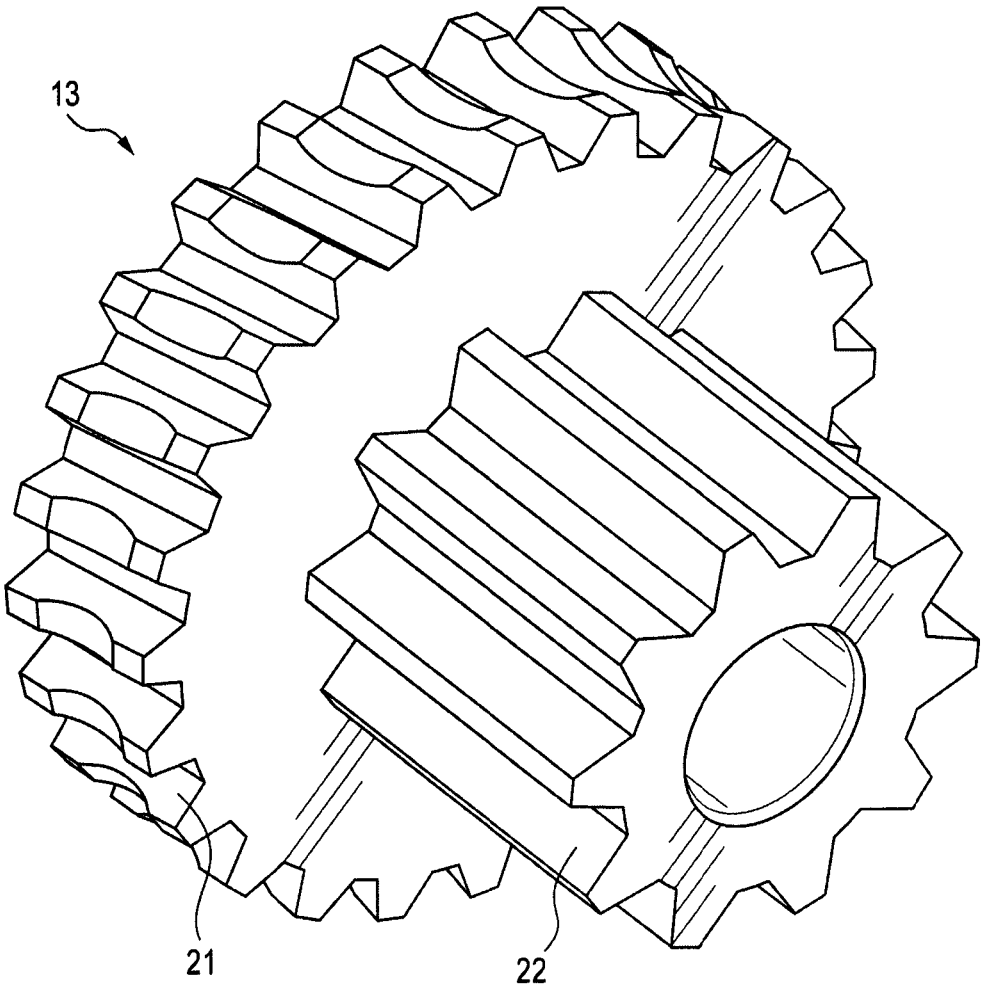
FIG. 2 shows an input pinion.

FIG. 2 illustrates an input pinion 13. The input pinion is coupled to the worm 12 (not shown) and the jack shaft 14 (not shown). The input pinion has two gears, an input pinion worm gear 21 and an input pinion spur gear 22. The input pinion worm gear meshes with the worm and has angled teeth to match the threading of the worm. The input pinion spur gear meshes with a spur gear on the jack shaft. The gear assembly must include at least one worm gear so that the gear assembly can be coupled to the worm.

Figure 3:
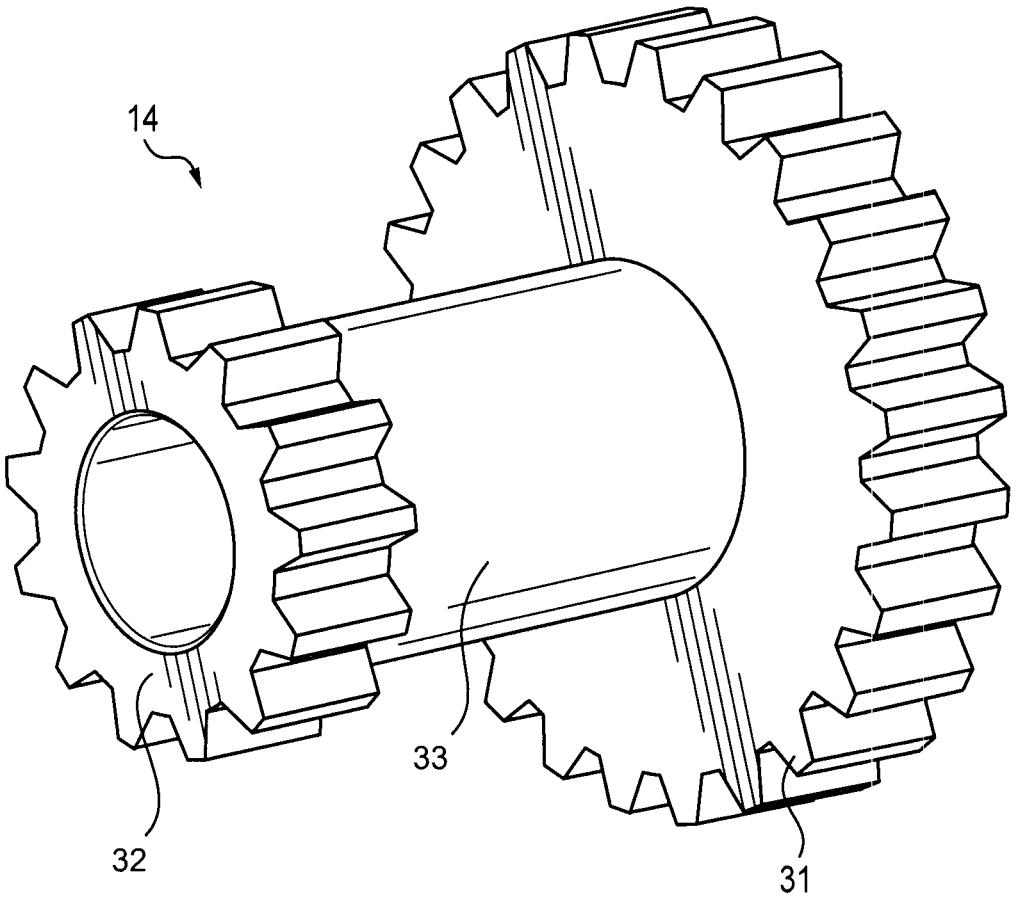
FIG. 3 shows a jack shaft.

FIG. 3 illustrates a jack shaft 14. The jack shaft is coupled to the input pinion 13 (not shown) and the output pinion 15 (not shown). The jack shaft has a first jack shaft spur gear 31, a second jack shaft spur gear 32, and a shaft 33 that connects the first jack shaft spur gear and second jack shaft spur gear. The first jack shaft spur gear meshes with the input pinion spur gear. The second jack shaft spur gear meshes with a spur gear on the output pinion.

Figure 4:
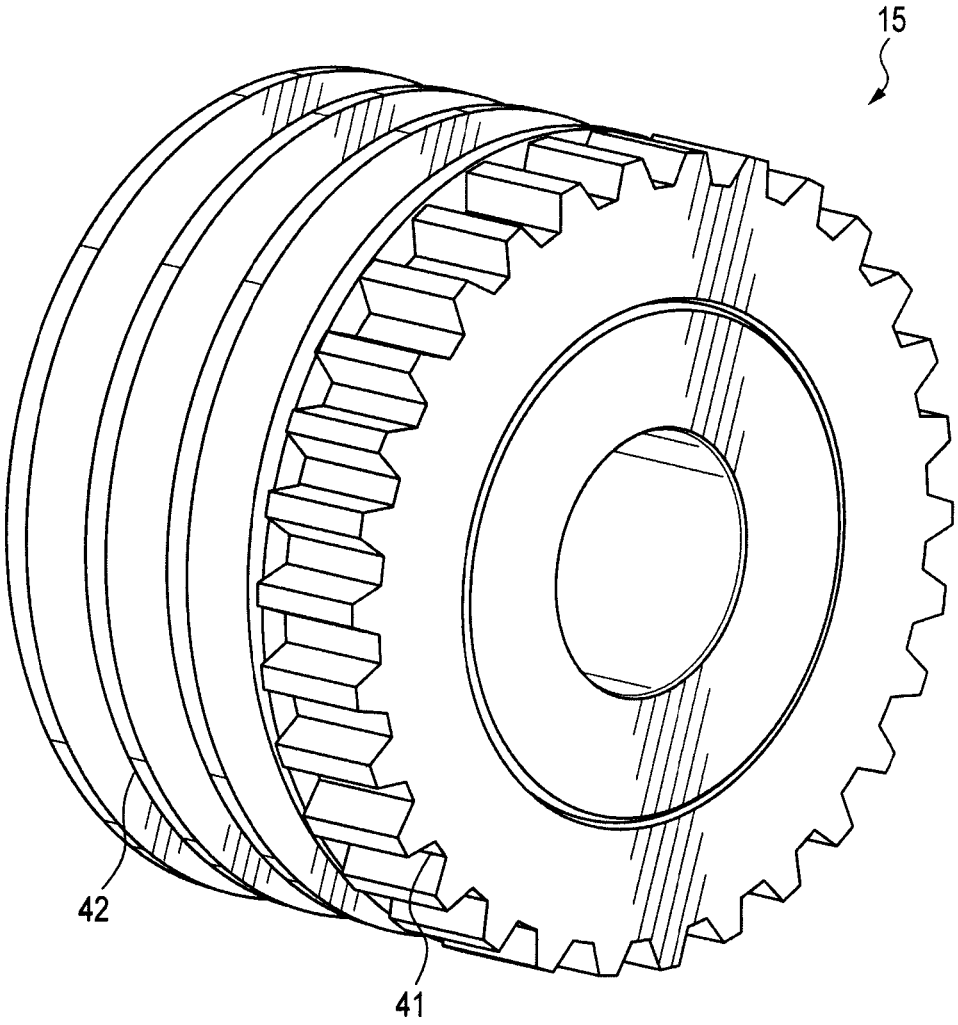
FIG. 4 shows an output pinion.

FIG. 4 illustrates an output pinion 15. The output pinion is coupled to the jack shaft 14 (not shown) and the clutch 16 (not shown). The output pinion has an output pinion spur gear 41 and an output pinion worm 42. The output pinion spur gear meshes with the second jack shaft spur gear. The output pinion worm meshes with a worm gear on the clutch.

Figure 5A:
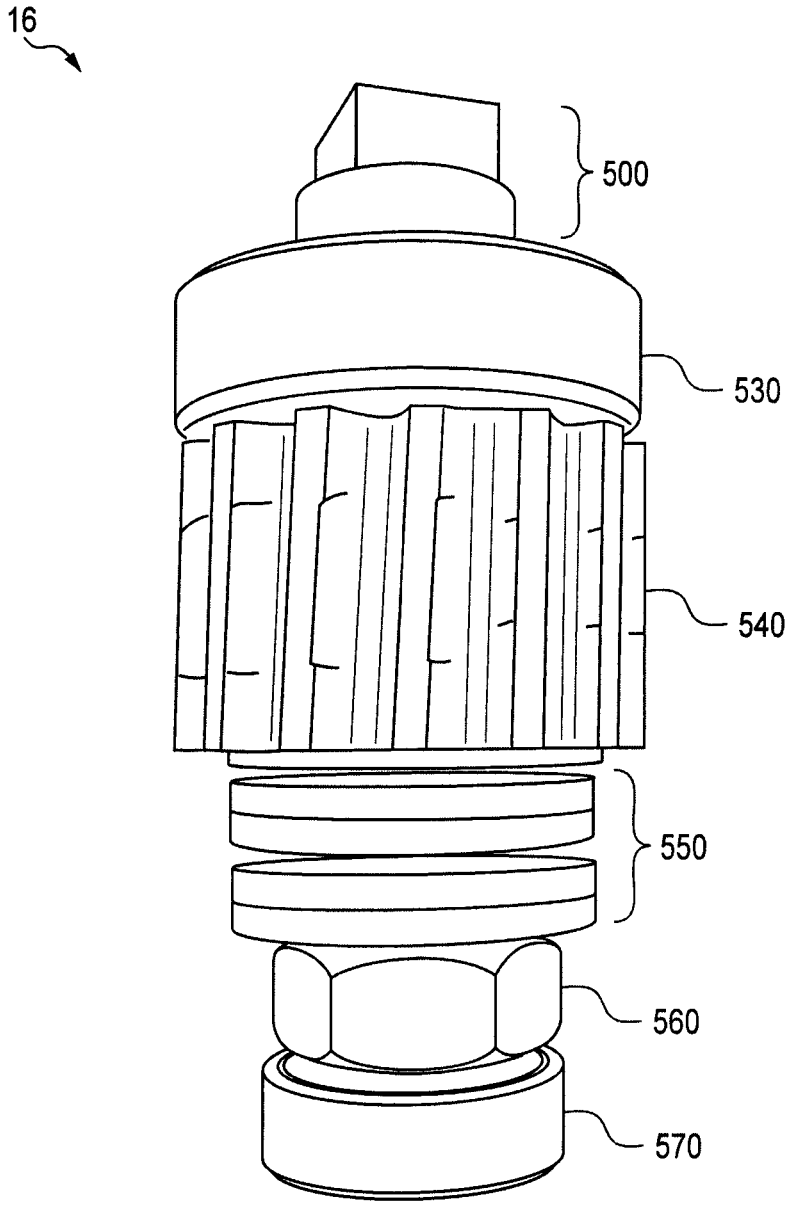
FIG. 5A shows a clutch.

FIG. 5A illustrates a clutch 16. The clutch is coupled to the output pinion 15 (not shown) and the output shaft 17 (not shown). The clutch comprises a shaft 500 (partially shown), an upper bearing 530, a clutch worm gear 540, a plurality of Belleville springs 550, a fastener 560, such as a nut, and a lower bearing 570. The shaft is shown in more detail in FIG. 5B. The output pinion worm meshes with the clutch worm gear. The rotation of the clutch worm gear causes the shaft to rotate, which results in movement of the output shaft.

Figure 5B:
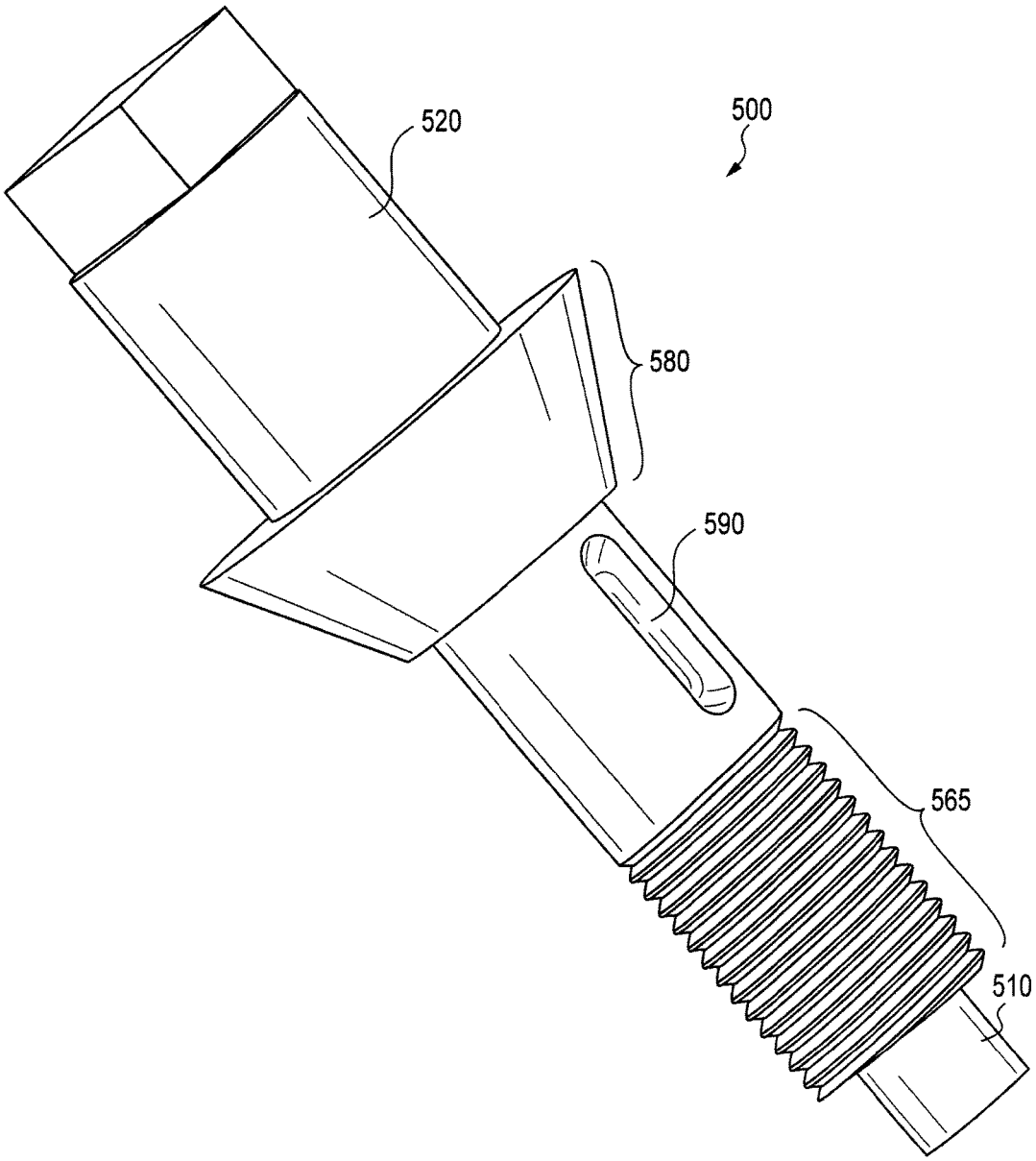
FIG. 5B shows a clutch shaft.

FIG. 5B shows the shaft 500. The upper bearing (not shown), clutch worm gear (not shown), plurality of Belleville springs (not shown), the fastener (not shown), and the lower bearing (not shown) are coupled to the shaft. The shaft includes a lower portion 510, an upper portion 520, a threaded portion 565, a fixed cone 580, and a keyway 590. The threading of the fastener corresponds to the threading on the threaded portion of the shaft. The upper bearing is on the upper portion of the shaft and the lower bearing is on the lower portion of the shaft. The shaft may be constructed of any durable, rigid material such as metals, plastics, or ceramics. The shaft may be monolithic or composed of multiple components. Preferably, the shaft is a monolithic metal component.

Figure 5C:
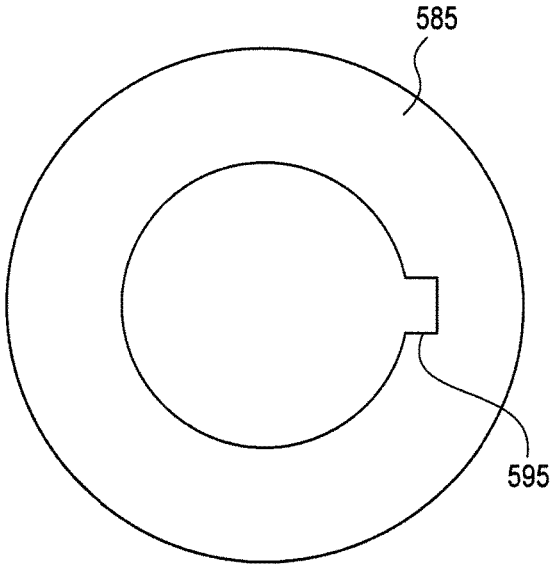
FIG. 5C shows a top view of a removable cone.
Figure 5D:
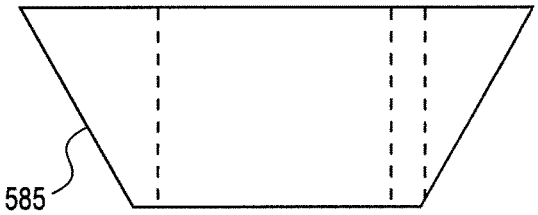
FIG. 5D shows a side view of a removable cone.

FIG. 5C shows a top view of a removable cone 585. FIG. 5D shows a side view of the removable cone. The removable cone is coupled to the shaft and is held in place by pressure from the clutch worm gear and the plurality of Belleville springs but is able to move laterally along the shaft. The removable cone has similar dimensions as the fixed cone but has a keyhole 595. The removable cone keyhole is aligned with the shaft keyway. The fixed cone and the removable cone are oriented such that the narrow portions of the cones face each other and the cones are covered by the clutch worm gear when the clutch is assembled. As the clutch worm gear rotates, friction between the clutch worm gear and the fixed cone and removable cone causes a corresponding rotation of the shaft. The removable cone may be constructed of any durable, rigid material such as metals, plastics, or ceramics. The removable cone may be monolithic or composed of multiple components. Preferably, the removable cone is a monolithic metal component.

Figure 5E:
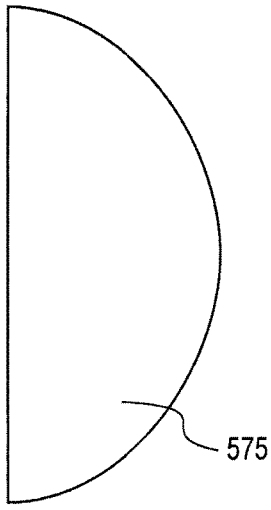
FIG. 5E shows a key.

FIG. 5E shows a key 575. The key is coupled to the shaft and is configured to fit in the shaft keyway. The removable cone surrounds the key and is able to move laterally along the key. The key prevents the removable cone from rotating around the shaft. The key may be constructed of any durable, rigid material such as metals, plastics, or ceramics. The key may be monolithic or composed of multiple components. Preferably, the key is a monolithic metal component.

The clutch prevents the door operator from continuing to move the door when the door encounters too much resistance. For example, if the door stops moving due to an obstruction, the rotation of the clutch is unable to cause a corresponding movement in the output shaft. When the clutch worm gear rotates without moving the output shaft, the clutch worm gear is displaced. The displacement of the clutch worm gear causes a similar displacement of the removable cone along the shaft towards the Belleville springs. The pressure from the displacement of the removable cone compresses the Belleville springs. When the removable cone and the clutch worm gear have been sufficiently displaced, friction between the clutch worm gear and the fixed cone is reduced or eliminated. As a result, the clutch worm gear may continue to rotate but is unable to cause the clutch shaft to rotate, preventing the motor and gear assembly from being damaged.

The clutch may be configured to disengage at any specified threshold resistance by selection of the Belleville springs. For example, the clutch may be configured to disengage upon encountering between 1 to 100 foot-pounds of resistance, 10 to 60 foot-pounds of resistance, or 20 to 45 foot-pounds of resistance. Selection of the type and number of Belleville springs determines the resistance at which the clutch disengages. When the obstruction is removed, the Belleville springs return to their relaxed state, which displaces the removable cone and restores the friction between the fixed cone and the clutch worm gear. This design allows the clutch to automatically re-engage the output shaft when the resistance is removed, and eliminates the need for manual resetting. The clutch serves the dual purpose of protecting the motor and preventing users from being crushed by the door.

The output shaft 17 shown in FIG. 1 is coupled to a door (not shown) and the clutch 16. The movement of the output shaft results in movement of the door. The output shaft can have any design or configuration that allows it to be coupled to the door and the clutch. Preferably, the output shaft is a monolithic metal component.

Figure 6:
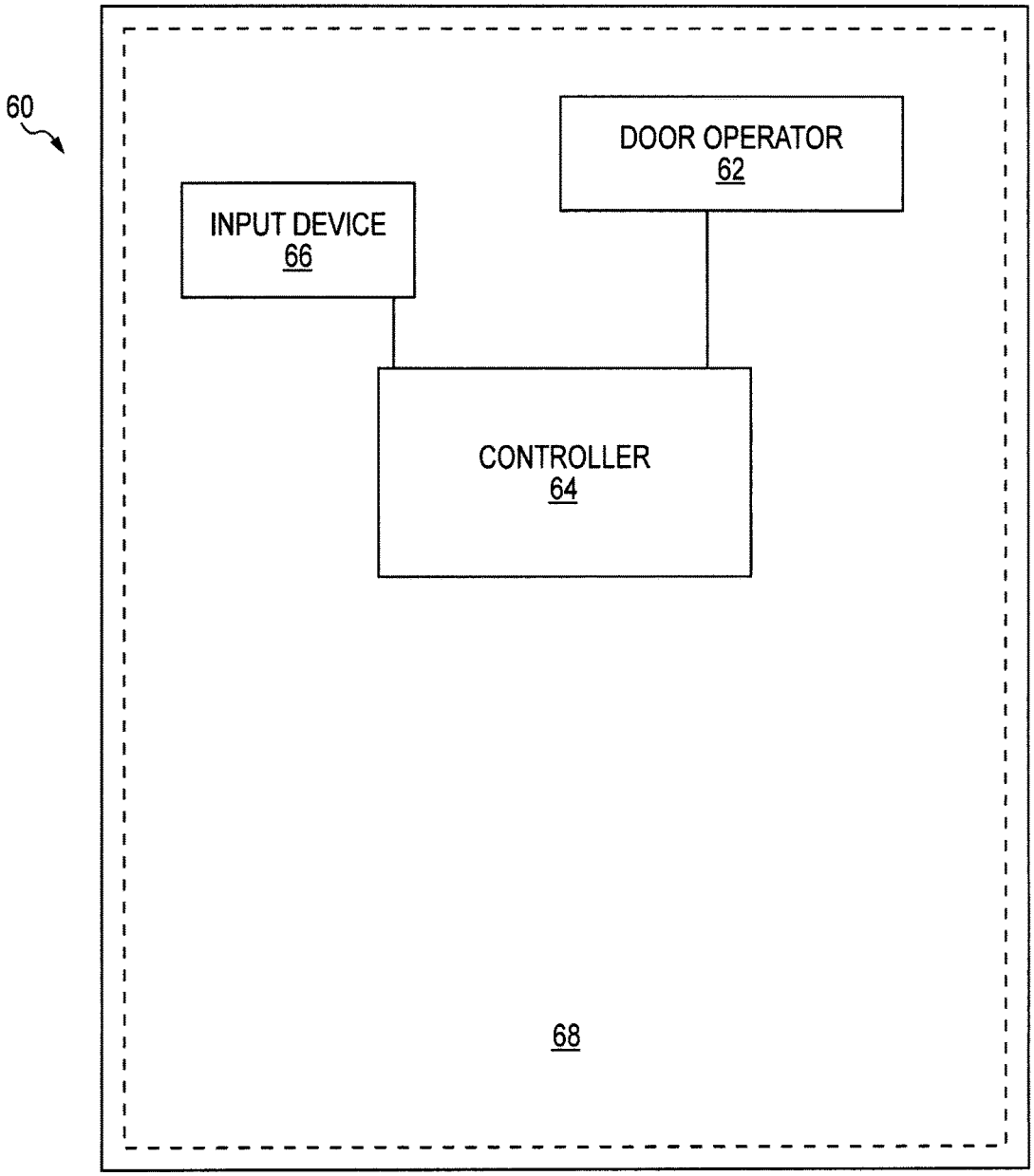
FIG. 6 shows a door with a door operator, a controller, and an input device.

FIG. 6 illustrates a door 60 with a door operator 62, a controller 64, and an input device 66. The door may be constructed, for example, of metal, wood, or composite materials and may be solid or hollow. The door may be monolithic or composed of multiple pieces, such as multiple outer faces 68 known as "door skins." The interior space between the door skins may be filled with various materials, such as spacers or fire resistant materials. The door operator may be attached to the outside of the door or may be located inside the door between first and second door skins.

The door operator may include a controller to control various actions or outputs based upon various inputs. The controller may be a microprocessor in electrical communication with the motor that manages the motor and generates appropriate signals to the motor to cause the motor to rotate and open or close the door. The controller receives information from an input device to determine when to open the door. The input device may be a manually operated input device such as a button, push pad, or wall switch. The input device may also be automatically operated by the physical proximity of the user. Automatic input devices include devices such as motion sensors, floor mats with integrated pressure sensors, infrared sensors, radio frequency sensors, or photoelectric cells. A signal from the input device causes the controller to direct a current having a first polarity to the motor, which then opens the door. The controller then directs a current having a second polarity opposite the first polarity to the motor to cause the motor to operate in reverse and close the door.

The controller provides an additional or alternative safety mechanism to prevent the door from continuing to move when it encounters resistance. The controller may be programmed to determine when the door has encountered an obstruction. An obstruction may be detected based on the position of the door, the time it takes for the door to open or close, or data supplied by the input device. For example, the controller may detect when the door remains open longer than a specified period of time. If the door normally returns to a closed position in 3 seconds, the controller may be programmed to interpret that when the door does not close within 3 seconds, the door has encountered an obstruction. When the controller detects an obstruction, it stops the current supply to the motor to prevent further door movement. The controller may then direct a current having the opposite polarity to the motor so that the motor operates in the opposite direction, moving the door and preventing further contact with the obstruction.

When the controller acts to prevent the door from continuing to move if the door encounters resistance, the clutch may be eliminated. In this embodiment, the door operator would have no mechanically-operated safety mechanism. The controller may stop the current supply to the motor instead of disengaging the motor if the door encounters resistance. Furthermore, the worm drive is coupled to the output shaft when a clutch is not present, by for example a gear assembly.

Figure 7:
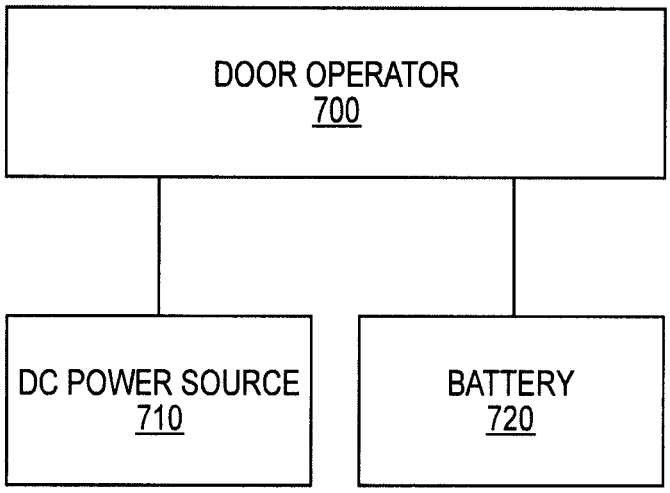
FIG. 7 shows a door operator with a secondary power source.

FIG. 7 illustrates a door operator 700 with a secondary power source. The door operator is powered by a DC power source 710. The door operator has a battery 720 as a secondary power source. The DC power source and the battery are both in electrical communication with the door operator.

Figure 8:
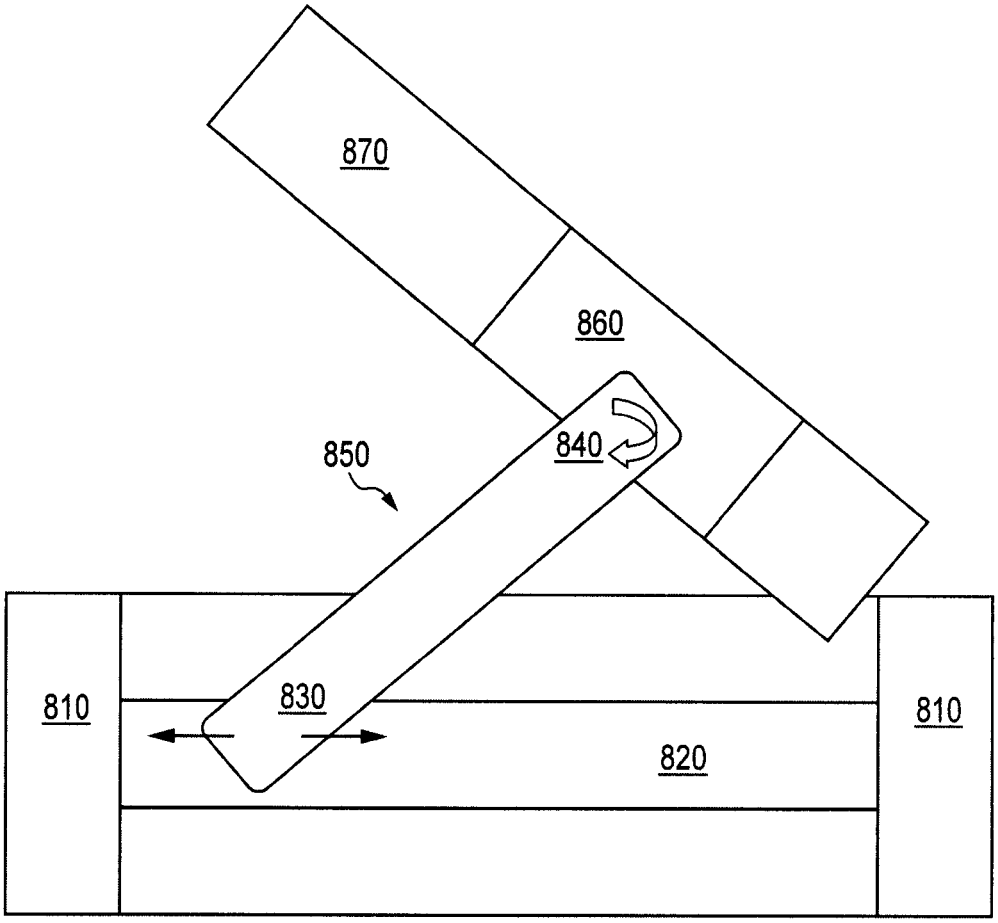
FIG. 8 shows a top view of a door and door operator within a door frame.

FIG. 8 illustrates a top view of a door and door operator within a door frame. The frame 810 is attached to a wall (not shown). The frame includes a track 820 that allows a first end 830 of an output arm 850 to slide along the track in the direction of the arrows. A second end 840 of the output arm is coupled to the output shaft (not shown) of the door operator 860. The door operator is coupled to the door 870. When the door operator is activated, the output shaft rotates the second end of the output arm in the direction indicated by the curved arrow which causes the first end of the output arm to slide along the track, moving the door open. Rotation of the second end of the output arm in the opposite direction causes the first end of the output arm to slide in the opposite direction along the track, moving the door closed.

Figure 9:
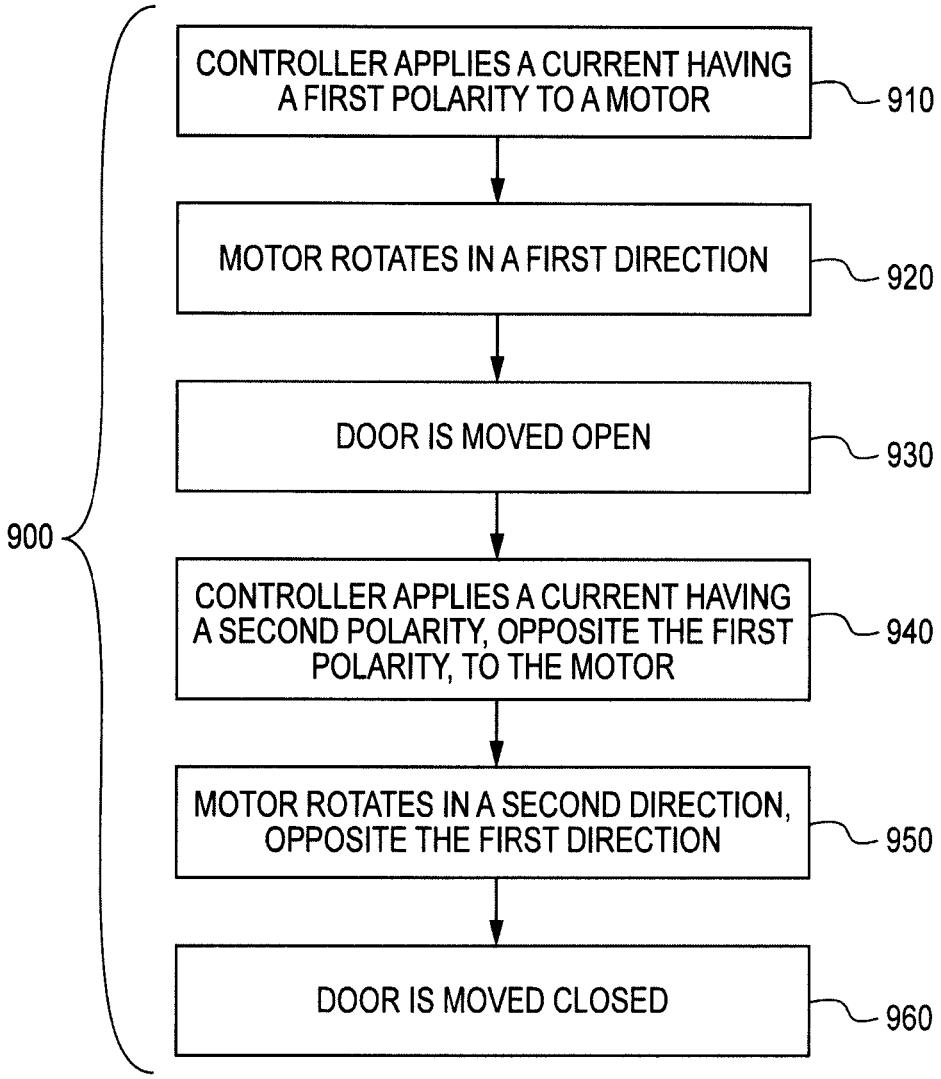
FIG. 9 shows a flow chart of a method of operating a door.

FIG. 9 illustrates a method of operating a door 900. First, a controller applies a current having a first polarity to a motor at 910, causing the motor to rotate in a first direction at 920 and moving the door open at 930. Next, the controller applies a current having a second polarity, opposite the first polarity, to the motor at 940, causing the motor to rotate in a second direction opposite the first direction at 950, and moving the door closed at 960.

While an embodiment of the invention has been described, it will be apparent to those of ordinary skill in the art that other embodiments and implementations are possible within the scope of the invention. Accordingly, the invention is not to be restricted except in light of the attached claims and their equivalents.

TABLE 1

| | |
|---|---|
| 10 | Door Operator |
| 11 | Motor |
| 12 | Worm |
| 13 | Input pinion |
| 14 | Jack shaft |
| 15 | Output pinion |
| 16 | Clutch |
| 17 | Output shaft |
| 21 | Input pinion worm gear |
| 22 | Input pinion spur gear |
| 31 | First jack shaft spur gear |
| 32 | Second jack shaft spur gear |
| 33 | Shaft |
| 41 | Output pinion spur gear |
| 42 | Output pinion worm |
| 60 | Door |
| 62 | Door operator |
| 64 | Controller |
| 66 | Input device |
| 68 | Outer face (door skin) |
| 100 | Gear assembly |
| 500 | Clutch shaft |
| 510 | Clutch shaft lower portion |
| 520 | Clutch shaft upper portion |
| 530 | Upper bearing |
| 540 | Clutch worm gear |
| 550 | Plurality of Belleville springs |
| 560 | Fastener |
| 565 | Threaded portion |
| 570 | Lower bearing |
| 575 | Key |
| 580 | Fixed cone |
| 585 | Removable cone |
| 590 | Keyway |
| 595 | Keyhole |
| 700 | Door operator |
| 710 | DC power source |
| 720 | Battery |
| 810 | Frame |
| 820 | Track |
| 830 | Output arm first end |
| 840 | Output arm second end |
| 850 | Output arm |
| 860 | Door operator |
| 870 | Door |
| 900 | Method of operating a door |
| 910 | Controller applies a current having a first polarity to a motor |
| 920 | Motor rotates in a first direction |
| 930 | Door is moved open |
| 940 | Controller applies a current having a second polarity, opposite the first polarity, to the motor |
| 950 | Motor rotates in a second direction, opposite the first direction |
| 960 | Door is moved closed |

What is claimed is:

1. A door operator, for opening and closing a door with a motor, comprising:

an input worm and an output worm, a gear assembly, coupling the input worm to the output worm, a clutch, coupled to the gear assembly via the output worm, and an output shaft coupled to the clutch and coupled to the gear assembly via the output worm, wherein the gear assembly comprises an input gear, comprising an input worm gear, coupled to the input worm, and an input spur gear;

an intermediate gear, comprising a first intermediate spur gear, coupled to the input spur gear, a second intermediate spur gear, and a shaft, coupled to the first intermediate spur gear and the second intermediate spur gear; and an output gear, comprising an output spur gear, coupled to the second intermediate spur gear and fixed to the output worm, and the gear assembly together with the worms has a step down gear ratio of at least 500:1.

2. The door operator of claim 1, wherein at least one of the input gear, the intermediate gear and the output gear comprises plastic.

3. The door operator of claim 1, wherein the step down gear ratio is at least 1000:1.

4. The door operator of claim 1, wherein the door operator does not comprise hardened steel.

5. The door operator of claim 1, wherein the door operator does not comprise a spring closer.

6. The door operator of claim 1, further comprising the motor, coupled to the input worm, wherein the motor is capable of rotating the output shaft in a first direction when current having a first polarity is applied to the motor, and rotating the output shaft in a second direction opposite the first direction when current having a second polarity opposite the first polarity is applied to the motor.

7. A method of operating a door with the door operator of claim 6, comprising:

applying the current having the first polarity to the motor, to rotate the output shaft in the first direction to open the door; and applying the current having the second polarity opposite the first polarity to the motor, to rotate the output shaft in the second direction opposite the first direction to close the door.

8. The door operator of claim 1, wherein the clutch disengages when subjected to a torque between 20 to 45 foot-pounds.

9. The door operator of claim 1, further comprising the motor, coupled to the input worm, and three 9 volt batteries, in communication with the motor, wherein the motor is a 24 volt motor, and the clutch disengages when subjected to a torque between 20 to 45 foot-pounds.

10. The door operator of claim 1 wherein the clutch comprises a clutch worm gear, coupled to the output worm.

11. The door operator of claim 10, wherein the clutch further comprises:

a clutch shaft having an upper portion, a lower portion, and a threaded portion, an upper bearing on the upper portion of the clutch shaft, a lower bearing on the lower portion of the clutch shaft, a fastener on the threaded portion of the clutch shaft, and a plurality of Belleville springs, wherein the fastener retains the Belleville springs on the clutch shaft.

12. A door assembly, comprising:

a door, a door operator, coupled to the door, comprising an input worm and an output worm, a gear assembly, coupling the input worm to the output worm, a clutch, coupled to via the output worm the gear assembly, and an output shaft coupled to the clutch and coupled to the gear assembly via the output worm, a motor, capable of moving the door between an open position and a closed position, coupled to the input worm, at least one battery, in communication with the motor, a controller, and an input device, wherein the gear assembly together with the worms has a step down gear ratio of at least 500:1, the door operator does not comprise a spring closer, the gear assembly comprises an input gear, comprising an input worm gear, coupled to the input worm, and an input spur gear;

an intermediate gear, comprising a first intermediate spur gear, coupled to the input spur ear, a second intermediate spur gear, and a shaft, coupled to the first intermediate spur gear and the second intermediate spur gear; and an output gear, comprising an output spur gear, coupled to the second intermediate spur gear and fixed to the output worm, and at least one of the input gear, the intermediate gear and the output gear comprises plastic.

13. The door assembly of claim 12 wherein the motor is, a low voltage motor.

14. The door assembly of claim 12, wherein the step down gear ratio is at least 1000:1.

15. The door assembly of claim 12, wherein the door operator is located within the door.

16. The door assembly of claim 12, wherein h clutch disengages when subjected to a torque between 20 to 45 foot-pounds.

17. The door assembly of claim 12, wherein the clutch comprises a clutch worm gear, coupled to the output worm.

18. The door assembly of claim 17, wherein the clutch further comprises:

a clutch shaft having an upper portion, a lower portion, and a threaded portion, an upper bearing on the upper portion of the clutch shaft, a lower bearing on the lower portion of the clutch shaft, a fastener on the threaded portion of the clutch shaft, and a plurality of Belleville springs, wherein the fastener retains the Belleville springs on the clutch shaft.

19. The door assembly of claim 12, wherein the motor is a 24 volt motor, the at least one battery comprises three 9 volt batteries, and the clutch disengages when subjected to a torque between 20 to 45 foot-pounds.

20. The door assembly of claim 19, wherein the door operator is located within the door.

* * * * *